US007990327B2

(12) United States Patent
Romanofsky

(10) Patent No.: US 7,990,327 B2
(45) Date of Patent: Aug. 2, 2011

(54) CELLULAR REFLECTARRAY ANTENNA AND METHOD OF MAKING SAME

(75) Inventor: Robert R Romanofsky, Hinckley, OH (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 12/874,370

(22) Filed: Sep. 2, 2010

(65) Prior Publication Data

US 2010/0328174 A1 Dec. 30, 2010

Related U.S. Application Data

(63) Continuation of application No. 11/871,237, filed on Oct. 12, 2007, now Pat. No. 7,791,552.

(51) Int. Cl.
*H01Q 19/06* (2006.01)

(52) U.S. Cl. ..... 343/754; 343/755; 343/700 MS

(58) Field of Classification Search ..... 343/753, 343/754, 755, 909, 781 P, 781 R, 700 MS
See application file for complete search history.

(56) References Cited

U.S. PATENT DOCUMENTS

| | | | | |
|---|---|---|---|---|
| 4,684,952 | A * | 8/1987 | Munson et al. | 343/700 MS |
| 6,081,234 | A * | 6/2000 | Huang et al. | 343/700 MS |
| 6,081,235 | A * | 6/2000 | Romanofsky et al. | 343/700 MS |
| 6,384,787 | B1 * | 5/2002 | Kim et al. | 343/700 MS |
| 6,441,787 | B1 * | 8/2002 | Richards et al. | 343/700 MS |
| 6,597,327 | B2 * | 7/2003 | Kanamaluru et al. | 343/909 |

* cited by examiner

*Primary Examiner* — Hoang V Nguyen
(74) *Attorney, Agent, or Firm* — Robert H. Earp, III

(57) ABSTRACT

A method of manufacturing a cellular reflectarray antenna arranged in an m by n matrix of radiating elements for communication with a satellite includes steps of determining a delay ϕm,n for each of said m by n matrix of elements of said cellular reflectarray antenna using sub-steps of: determining the longitude and latitude of operation, determining elevation and azimuth angles of the reflectarray with respect to the satellite and converting theta$_0$ ($\theta_0$) and phi$_0$ ($\phi_0$), determining $\Delta\beta_{m,n}$, the pointing vector correction, for a given inter-element spacing and wavelength, determining $\Delta\phi_{m,n}$, the spherical wave front correction factor, for a given radius from the central element and/or from measured data from the feed horn; and, determining a delay ϕm,n for each of said m by n matrix of elements as a function of $\Delta\beta_{m,n}$ and $\Delta\phi_{m,n}$.

17 Claims, 13 Drawing Sheets

CELLULAR REFLECTARRAY ANTENNA AND METHOD OF MAKING SAME

CROSS-REFERENCE TO RELATED APPLICATIONS

This application is a continuation of U.S. patent application Ser. No. 11/871,237, filed Oct. 12, 2007, now U.S. Pat. No. 7,791,552 the entire disclosure of which is hereby incorporated by reference herein.

The invention described herein was made by an employee of the United States Government, and may be manufactured and used by the government for government purposes without the payment of any royalties therein and therefor.

FIELD OF THE INVENTION

The field of the invention is in antennas and, in particular, in the field of reflectarray antennas used for communication with earth-orbiting satellites.

BACKGROUND OF THE INVENTION

The reflectarray is an alternative to directly-radiating phased array antennas and promises higher efficiency at reduced cost. A key advantage of reflectarray antennas over conventional phased arrays is elimination of the complex beam-forming manifold and costly transmit/receive modules. The reflectarray is also reciprocal—the same aperture can be used for transmit and receive functions. In 1963, Berry, Malech and Kennedy introduced this new class of antennas that utilized an array of elementary antennas as a reflecting surface.

In 1976, Phelan patented (U.S. Pat. No. 3,949,407) a scanning reflectarray based on interleaved Archimedian spiral antennas. Spiral arms were interconnected with diode switches. The spirals are inherently circularly polarized over a broad bandwidth. (i.e., the far-field phase shift from a circularly polarized radiator is proportional to the apparent physical rotation of the radiator.)

In 1978 Malagisi proposed a microstrip reflectarray. In a microstrip reflectarray, stubs aligned with the desired polarization direction and of varying length are attached to the elements to effect phase shift. Incident energy from the primary feed propagates down the stub, where it reflects from the open (or short) end, and re-radiates with a delay corresponding to twice the electrical length of the stub.

A circularly polarized microstrip reflectarray with a 55% efficiency was reported by Huang and Pogorzelsk in an article entitled Ka-Band Microstrip Reflectarray with Elements Having Variable Rotation Angles, IEEE Transactions On Antennas and Propagation, Vol. 46, No. 5, May 1998. The antenna used square patches with identical stubs but varying rotation angles. Huang discloses a means of achieving cophasal far-field radiation for a circularly polarized microstrip reflectarray with elements having variable rotation angles. Two Ka-band half-meter microstrip reflectarrays were fabricated and tested. One of the arrays was of conventional design having identical patches with variable length microstrip phase delay lines attached. The other array had identical square patches with identical microstrip delay lines but different element rotation angles. The element with variable rotation angles resulted in better performance according to Huang.

In 2000, Romanofsky and Miranda disclosed a scanning reflectarray antenna based on thin-film ferroelectric phase shifters. None of these technologies provided a practical or cost effective means to replace parabolic reflectors intended for communications with geostationary satellites. The current state-of-practice is to use a solid parabolic reflector which must be physically pointed directly at the satellite in order to establish a communications link.

U.S. Pat. No. 6,081,235 to Romanofsky et al. disclosed a corrugated feed horn attached to nonmetallic struts situated at the virtual focus of the antenna. Further, the '235 patent to Romanofsky et al. states that "[t]he incident circularly polarized signal is absorbed by each element of the reflectarray, routed through the stubs, which are in turn connected to the phase shifters, and re-radiated with a phase shift equal to twice the electrical length of the stubs-coupled electrical lines arrangement. By varying the bias across the coupled lines of each element, the appropriate phase shift can be attained, for electronic scanning without any physical movement of the antenna to produce the desired beam steering." The row-column steering concept is a way to cut manufacturing cost but limits field of view. In the '235 patent the cellular array compensates for the spherical phase from the feed by tuning ferroelectric phase shifters.

U.S. Pat. No. 6,384,787 to Kim et al. discloses a flat reflectarray antenna utilizing a polarization twist function and predetermined phase shifts to provide a directed narrow beamwidth signal as set forth in col. 1 lns. 5-8. It is apparent that Kim et al. does not apply to circular polarization, cellular implementation, or thick, high dielectric constant substrates.

Several concepts for reflectarrays have been proposed but the usual context has been as a replacement for a parabolic dish that is mechanically pointed to a target or a as a competitor to directly radiating Gallium Arsendie Monolithic Microwave integrated Circuit phased arrays.

FIG. 10 is a prior art schematic 1000 of a patch antenna 102 fed orthogonally with microstrip lines for the purpose of evaluating the polarization of the reflected field. In principle, the image can be cross-polarized with respect to the desired beam. Consider the simplified schematic of a patch antenna attached to orthogonal microstrip lines feeding some type of combiner that ostensibly leads to a variable phase shifter as shown in FIG. 10, where $\Delta x=\Delta y+\pi/2$. In practice, a quadrature (90°) hybrid coupler or equivalent would be used to couple the patch to the phase shifter. The reflectarray is in the X-Y plane. Assume that the incident wave is in the minus z direction and right hand circularly polarized (RHCP) such that $E_{inc}=(ju_x-u_y)e^{i(\beta z-\omega t)}$ where $u_x$ and $u_y$ are unit vectors in the x- and y-directions respectively. Ignoring the time dependency, the reflected field is $E_{re1}=(-ju_x-u_y)e^{j(2\beta\Delta y-\beta z)}$ and the electric field vector angle is easily shown to be proportional to $\omega t$ so it is likewise RHCP. Phase shifter contributions are neglected. The signal reflected from the ground plane will be LHCP due to the reversal of propagation direction. It can be shown that, in general, if one arm of the patch is 90 degrees longer than the other, the reflected signal will have the same sense polarization as the incident signal.

SUMMARY OF THE INVENTION

A reflectarray comprises a flat surface with diameter D, containing M×N integrated phase shifters (i.e. delay transmission lines) and M×N patch radiators with inter-element separation d, that is illuminated by a single feed at a virtual focus located a distance F from the surface such that F/D≈1. This value of F/D is a reasonable compromise between feed gain (and blockage) for proper illumination and modulo 2π effects. A priori settings of all phase shifters (i.e. delay transmission lines) are used to compensate for the spherical wavefront from the feed. The computer code calculates these compensation factors based on measured and/or theoretical feed information. That is, in order for the reflectarray to emulate a parabolic surface, the phase shifters are adjusted to compensate for the increasing path length from the aperture center towards the perimeter. The modulated signal from the feed passes through the reflect-mode phase shifters (i.e. delay transmission lines) and is re-radiated as a focused beam in essentially any preferred direction in the hemisphere in front of the antenna as in a conventional phased array. Of course the physics insofar as inter-element spacing, mutual coupling, scan loss, etc. is concerned is the same as for a conventional array that uses a transmission line manifold to distribute the signal among the M×N elements.

The actual field in beam direction $U_o$ consists of the desired re-radiated field from the patch elements, scattered fields from the ground plane and phase shifters, and possibly a direct field from the feed.

For example, a radar cross-sectional measurement of a 208 passive element was made to determine the E-field for a non-optimal selection of a dielectric constant and thickness. The 208 passive element reflectarray was constructed using a non-optimal selection of a 0.79 mm thick substrate with a dielectric constant of 2.2. Microstrip π radian delay lines on every other passive element were oriented such that they would be sensitive only to vertical polarization. The array obverse (patch side) was designed to place main beams at ±30 degrees at 19 GHz. Undesirable scattered energy from the ground plane at boresight was nearly as prominent as the desired beams (at ±30°) because of the non-optimal selection of a dielectric constant. The image of the feed will be projected normal to the reflectarray surface because of scattering, primarily from the ground plane. The array reverse (ground plane only) indicated the image pattern of the feed horn.

In practice, the aperture gain must be much greater than the feed gain to mitigate this effect. Reduced cross-polarization is achieved by choosing an appropriate dielectric constant and thickness of the substrate material equal to the guided wavelength divided by four such that the cross-polarization scattered from the elemental radiators on the front surface interferes destructively with the cross-polarized signal reflected from the ground plane on the back surface.

The program was written in MathCAD and accepts a cellular reflectarray pointing direction (θ and ϕ) as inputs as well as a file containing measured phase data from the microwave feed horn. The code calculates the a priori settings of the passive (transmission line) phase shifters to compensate for the spherical distortion of the feed. (i.e., energy from the feed illuminates the middle of the reflectarray prior to the ring of the reflectarray). This process causes the cellular reflectarray to emulate a conventional parabolic reflector. The code then calculates the additional incremental delay required for each patch (or alternatively radiating element) in order to form a cophasal beam in essentially any preferred direction in the hemisphere in front of the array. A matrix corresponding to the individual M×N elements of the cellular reflectarray such that each entry is the associated delay in degrees is produced. A matrix corresponding to the actual elemental M×N transmission line physical lengths is also produced. The actual number of elements is truncated for a practical circular aperture of diameter D inscribed inside the rectangular aperture defined by M×N A method of manufacturing a cellular reflectarray antenna is disclosed and claimed. The reflectarray antenna is arranged in an m by n matrix of passive elements. Each of the elements has a delay transmission line associated therewith which contributes to the formation of a narrow cophasal beam The method of manufacturing the antenna includes the step of determining a delay for each of the m by n elements of the cellular reflectarray antenna. The step of determining a delay for each of the m by n matrix of elements includes several sub-steps, namely, determining the longitude and latitude of the location in which the reflectarray antenna will operate, determining elevation and azimuth angles of the reflectarray with respect to an orbiting satellite, converting the elevation and azimuth angles to spherical, Cartesian and then a rotated coordinate system to obtain theta (ϕ) and phi (ϕ), converting theta (θ) and phi (ϕ) to $theta_0$ ($\theta_0$) and $phi_0$ ($\phi_0$) expressed as radians, determining $\Delta\beta_{m,n}$ for a given ρ equal to d/λ for a specific array where d is the inter-element spacing and λ is the wavelength, determining $\Delta\phi_{m,n}$ for a given radius from the central element and/or from measured data from the feed horn, and, determining a delay for each of said in by n matrix of elements as a function of $\Delta\beta_{m,n}$ and $\Delta\phi_{m,n}$. An additional step of converting the delay calculated in degrees to a stub line length (inches or millimeters) is also desirable so that the relectarray can be easily manufactured using printed circuit board techniques including photolithography.

A cellular reflectarray antenna for communicating with a satellite wherein a plurality of printed passive antenna elements are arranged in an m by n matrix such that each of the printed passive elements includes a phase delay ϕm,n is disclosed and the phase delay is accomplished by adding stubs of sufficient length and geometry for the particular application. The delay lines, sometimes referred to as stubs, are oriented in the space between elements of the matrix. The phase delay is $\phi m,n \leftarrow \mathrm{mod}(phase_{m,n},360)$, where $phase_{m,n} \leftarrow -360+\Delta\beta_{m,n}\cdot(180\div\pi)-\Delta\phi_{m,n}$, where $\Delta\beta_{m,n}:=\mathrm{mod}\,[-2\cdot\pi\cdot\rho\cdot[m\cdot(\sin(\phi_o)\cdot\cos(\phi_o)+n\cdot(\sin(\theta_o)\cdot\sin(\phi_o))],\ 2\cdot\pi]$ and where $\Delta\phi_{m,n}$ is selected from the group of a mathematical function of the radius from a central printed passive element of the array (look-up table) and/or it is selected from measured data. The phase delay $\phi_{m,n}$ is a delay line emanating from said printed passive element and it has a distinct length and width depending on the material used and the frequency of operation of the array.

It is an object of the present invention to enable use of a flat reflectarray having a plurality of passive elements thereon with specific delay lines interconnected to each of the passive elements such that the delay lines provide spherical wave front compensation from the feed horn and pointing vector compensation enabling the manufacture of a specific reflectarray for an area at or within a specified distance from a given longitude and latitude.

It is an object of the present invention that the delay lines provide spherical wave front compensation where $\Delta\phi_{m,n}$ is determined and selected from the group of a mathematical function of the radius from a central printed passive element of the array (i.e., a look-up table) and/or it is selected from measured data.

It is an object of the present invention that the delay lines provide spherical wave front compensation where $\Delta\phi_{m,n}$ is determined by a mathematical function dependent on the radius from a central printed passive element of the array, the frequency of operation, and the distance of the feed horn (i.e. a look-up table).

It is an object of the present invention that the delay lines provide spherical wave front compensation where $\Delta\phi_{m,n}$ is determined by the combination of a mathematical function dependent on the radius from a central printed passive element of the array, the frequency of operation, and the distance of the feed horn (i.e., a look-up table) and interpolated measured data.

It is an object of the present invention that the delay lines provide pointing vector delay calculations, namely, $\Delta\beta_{m,n}=\mathrm{mod}\ [-2\cdot\pi\cdot\rho\cdot[m\cdot(\sin(0_o)\cdot\cos(\phi_o))+n\cdot(\sin(0_o)\cdot\sin(\phi_o))]$, $2\cdot\pi$], where $\rho$ is $d/\lambda$ (d is inter-element spacing and $\lambda$ is the wavelength at operation), and ($\theta_0$), ($\phi_0$) are pointing angles from the specific reflectarray location to an orbiting satellite.

It is an object of the present invention to provide a bidirectional dual broadband television and internet reflectarray which is: unobtrusive in use, easily and quickly installed through simple orientation due north and parallel to the earth, inexpensive, and not removable from the cell in which it is originally installed.

It is an object to manufacture a relectarray antenna having a plurality of antenna elements arranged in a matrix of elements ranging from a small M×N matrix to a matrix having greater than 10,000 elements.

It is an object of the present invention to use high impedance microstrip lines printed on the same substrate as the radiators/patches and the microstrip delay lines are in intimate contact with the radiators/patches, however, other types of transmission lines may be used such as coplanar or suspended striplines.

These and other objects of the invention will be better understood when reference is made to the Brief Description of the Drawing, Description of the Invention and Claims which are set forth below.

Figure 1:
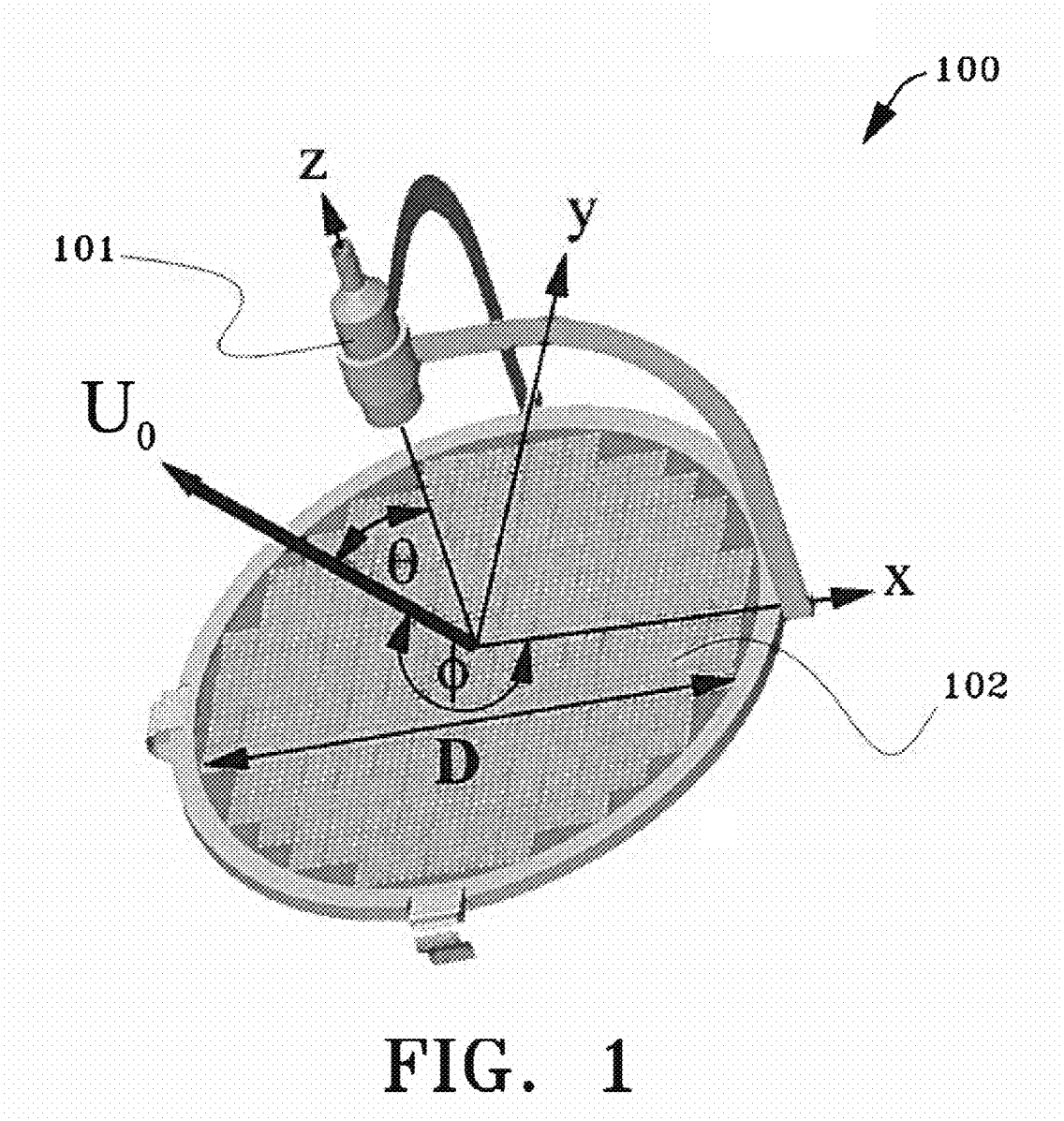
FIG. 1 illustrates an exemplary cellular reflectarray.

The drawings will best be understood by referring to the Description of the Invention and Claims which follow hereinbelow.

DESCRIPTION OF THE INVENTION

The cellular reflectarray antenna is intended to replace conventional parabolic reflectors that must be physically aligned to a particular satellite in geostationary orbit. Specifically, the cellular reflectarray antenna is designed for a certain geographic location defined by latitude and longitude that is called a "cell". A particular cell may occupy approximately 1,500 square miles. Other cell sizes are specifically contemplated herein and may be necessary for high±latitudes. The cellular reflectarray antenna designed for a particular cell is simply positioned such that an index aligns to magnetic North and the antenna surface is level (parallel to the level ground). A given cellular reflectarray antenna will not operate in any other cell because the delay lines for the individual elements are specific to that cell.

The specific design and fabrication of the reflectarray for a specific latitude and longitude (i.e. a zip code) inherently prevents pirating dish receiver systems since the antenna will only operate for the latitude and longitude for which is was designed. That is, the site specific antenna thwarts relocation of the system for the purpose of avoiding subscription fees.

The design avoids the need for a highly skilled installer to mechanically point the antenna. The technique also offers an inherent benefit since the equipment will not operate outside of its designed cell space. Next generation "Direct TV" markets are expected to operate at Ka-band frequencies and provide asymmetric duplex communications to enable very wideband (e.g. MBPS) internet access in addition to conventional or high definition television programming.

Geostationary satellites occupying several orbital slots near 101 degrees West will provide service to North America. Subscribers to these new services will require ground terminals with significantly larger apertures than had been used previously for Ka-band Direct TV, which provided only downlink entertainment programming. The state-of-the-art technology for these consumer ground stations is a parabolic reflector antenna system, colloquially referred to as a dish antenna system. To meet link requirements these parabolic reflectors will need to be at least 26 inches in diameter. At 29 GHz the corresponding beamwidth is about 0.9 degrees. The industry has several legitimate concerns with the current approach to subscriber ground stations. The techniques described herein are not limited to a particular continent or application and may be used in any geographic zone and with any Geostationary satellite.

Consumers may be reluctant to install unsightly and bulky antenna systems on their properties. There is no way for the state-of-the-art technology to blend into landscapes or rooflines. Because of the narrow beamwidth, dish alignment will be particularly difficult and necessitate that a highly trained technician install the reflector perhaps from a difficult location like a roof top. Specialized equipment might be required for alignment. At even moderately Northern latitudes the dish will be pointed at acute angles from Zenith. Wind loading and wind gusts are likely to induce enough vibration to misalign the antenna beam and cause signal loss. Again this problem arises because of the narrow beamwidth.

Consequently, the Direct TV and satellite industry desires subscriber ground terminals that are: aesthetically pleasing, easily aligned such that a typical consumer can install his or her own antenna system, and flat such that wind loading is no longer an issue.

A given reflectarray supplied to a subscriber contains an index indicating how to align (point) the reflectarray to magnetic North. The subscriber requires only knowledge of magnetic North from his or her location. This knowledge is satisfied with a simple compass and the reflectarray antenna is aligned accordingly therewith. The only orientation requirement is that the reflectarray is level (i.e. parallel to the ground). Transmission lines integrated with the elemental radiators are used to induce circular polarization and provide the proper electrical delay to achieve the required phase shift for that element to contribute effectively to forming a collimated antenna beam in the direction of the geostationary satellite. If transmission lines are affixed to orthogonal edges of an elemental radiator and one line is electrically 90 degrees longer than the other, the reflected signal from the feed will be polarized in the same sense as the feed. The signal scattered from the elemental radiators and ground plane will be oppositely polarized by virtue of the reversal of propagation direction.

FIG. 1 illustrates 100 an exemplary cellular reflectarray. The basic cellular reflectarray platform configuration (topology of array surface is unique to a given geographic cell) is shown. The y-axis is aligned with magnetic North, declination inaccuracy being accounted for a-priori in the design. The z-axis is perpendicular to the ground. Pointing angles $\theta$ and $\phi$ are the beam pointing directions such that a single main beam is generated along vector Uo. Array diameter D is application dependent but approximately 0.66 m for next generation Ka-band "DirecTV" applications. Horn feed 101 transmits and receives electromagnetic waves or radiation to and from the reflectarray surface. Unnumbered feed supports are made of plastic or some other dielectric material. A plurality of passive elements 102 (radiator patches) are located on the dielectric substrate which supports the reflectarray. Passive elements 102 are made of copper or coated copper to prevent oxidation. Other electrically conductive materials may be used for the patches such as those typically used in patch array antennas.

Figure 2:
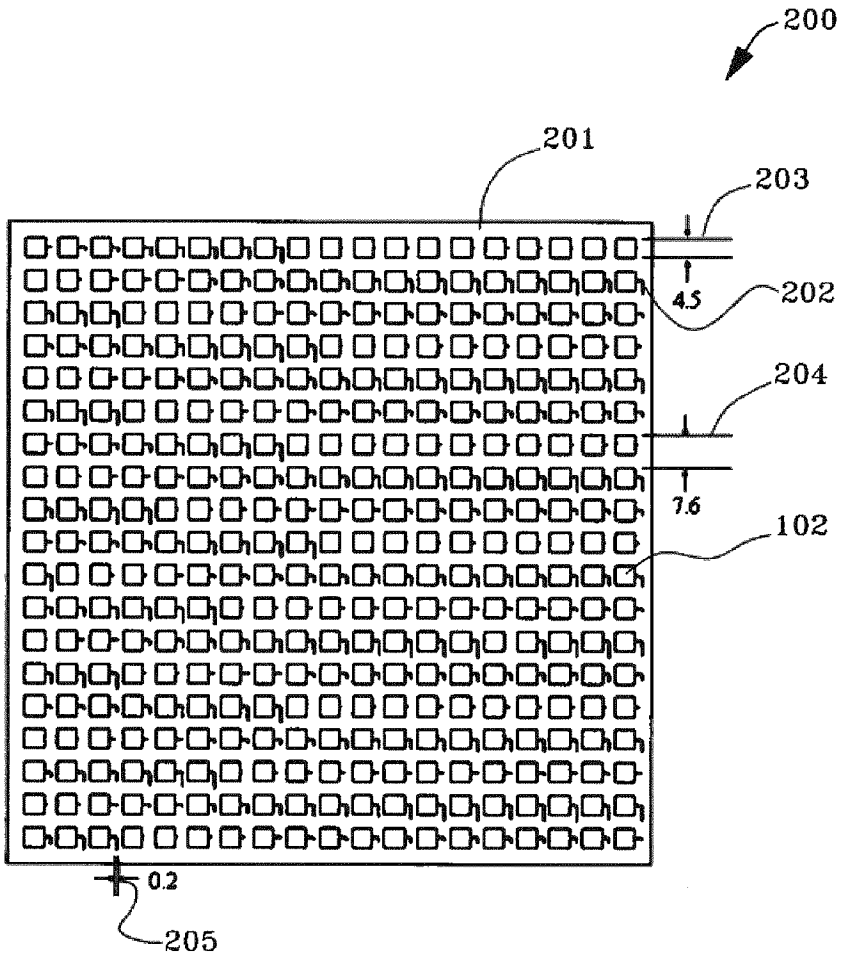
FIG. 2 is a schematic 19×19 element central cellular reflectarray section illustrating the topology of an array surface.

The cellular reflectarray can transmit and receive circular or linear polarization. If one side of the passive element has a delay 90° longer than the orthogonal side the patch will radiate the same sense circular polarization as the feed. If the orthogonal edges have the same delay length then the re-radiated signal will be oppositely polarized. A conventional rectangular waveguide can be used at the feed if only linear polarization is required and this means that a transmission line stub may be attached to one side of the patch in the "x" direction for horizontal polarization or in the "y" direction for vertical polarization FIG. 2 is a 19×19 element central cellular reflectarray section 200 illustrating, schematically, the topology of the array surface. The design corresponds to a Las Vegas, Nev. "cell" communicating to the ANIK II satellite such that the pointing angle is $\theta$=47.9° and $\phi$=173.2°. Circuit board material 201 is 0.75 mm thick with a dielectric constant of 2.2. Passive elements 102 are 4.5 mm (203) on each side thereof with an inter-element separation of 7.6 mm (204). Delay lines 202 are illustrated schematically and are 0.2 mm (205) in width and random orientation of them reduces cross polarization.

Figure 3A:
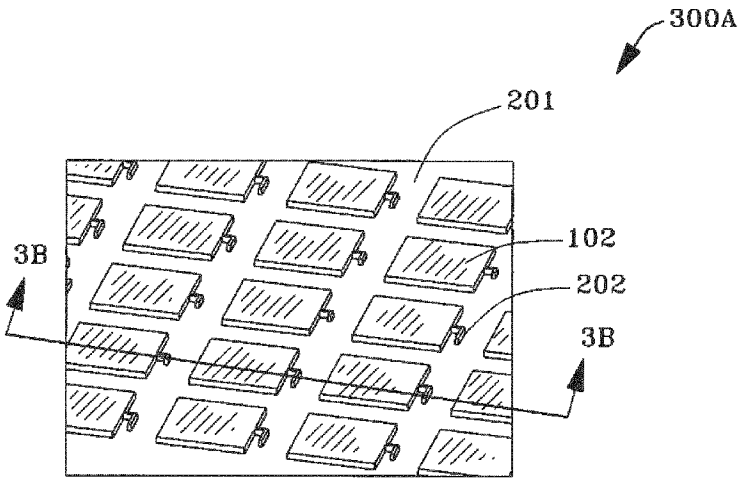
FIG. 3A is a perspective view of a section of the cellular reflectarray illustrating the passive elements and delay lines.
Figure 3B:
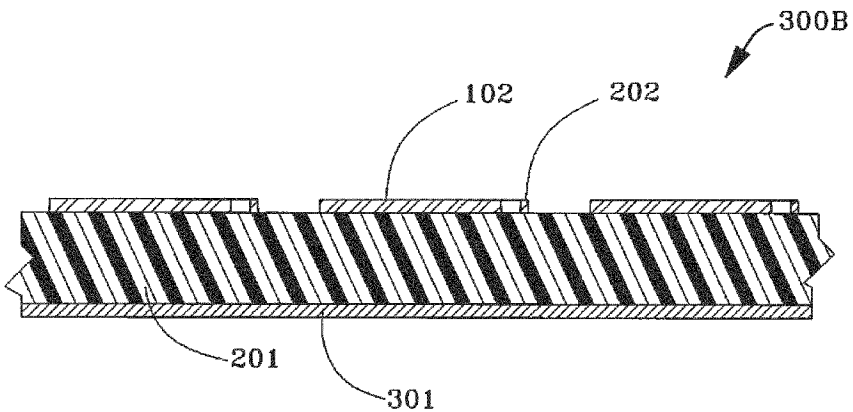
FIG. 3B is as cross-sectional view taken along the lines 3B-3B of FIG. 3A.

FIG. 3A is a perspective view 300A of a section of the cellular reflectarray illustrating the elements 102 and delay lines 202 in more detail. FIG. 3B is a cross-sectional view 300B taken along the lines 3B-3B of FIG. 3A and illustrates a metallic ground plane 301 on the back side of the substrate (circuit board material 201).

Figure 4A:
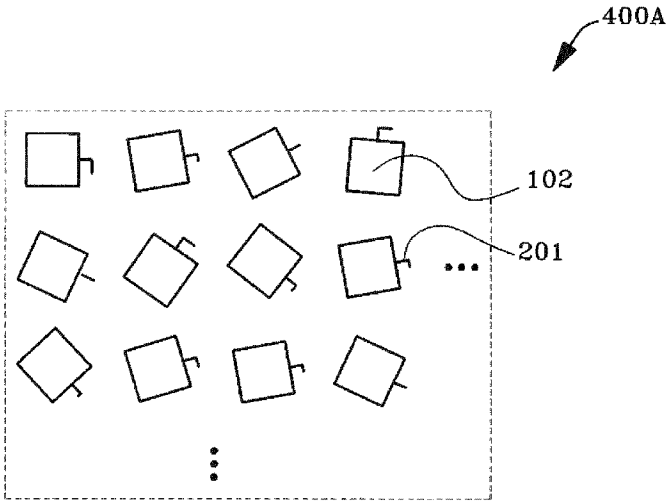
FIG. 4A (PRIOR ART)
FIG. 4A is a plan view of a portion of a reflectarray illustrating random orientation of the elements to reduce cross-polarization.

FIG. 4A is a plan view 400A of a portion of a reflectarray illustrating a random orientation of the passive elements to reduce cross-polarization. Correction of the phase due to the rotation of the passive elements is expected to reduce cross polarization.

Figure 4B:
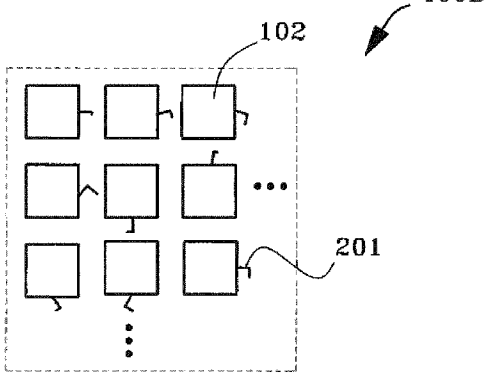
FIG. 4B is a plan view of a portion of a reflectarray illustrating patches having random delay line orientations.

FIG. 4B is a plan view 400B of a portion of a reflectarray illustrating patches having random orientations of the delay lines 202. The random orientation of the delay lines is expected to reduce undesirable cross polarization. The delay lines can have other shapes as long as consideration is paid to capacitance and other issues.

Figure 5:
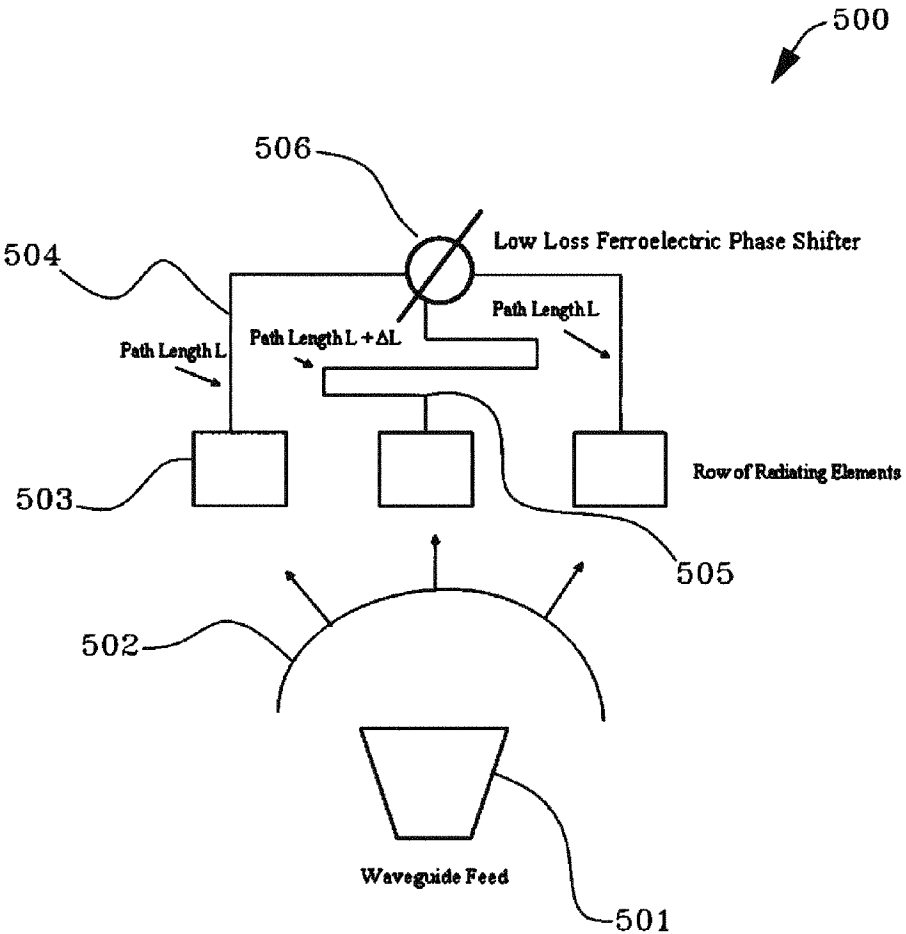
FIG. 5 is a schematic illustration of one possible line by line compensation structure and method for the spherical wavefront of the feed in a cellular reflectarray.

FIG. 5 is a schematic illustration 500 of one possible compensation structure and method applied on a line by line arrangement of elements 503 to compensate for the spherical wave front of the feed used with a reflectarray. The central element path length 505 must be longer by some $\Delta L$, where $\Delta L<2\pi$, such that the spherical wave 502 from the feed is in phase at the phase shifter 506 with the wave arriving at the rightmost and leftmost element along path L (504) (i.e. the electromagnetic wavelet enters the central element first). The re-radiated fields will not be in phase and could not be adjusted to accomplish a signal pointing along a vector $U_0$. A feed providing a plane wave (in phase at the Reflectarray surface) solves this problem at the possible expense of spill-over loss. The example provided by FIG. 5 is another example separate and apart from the examples described elsewhere herein in regard to the determination of delay line length in the totally passive system. One dimensional electronic beam steering can be effected which would enable a single tunable phase shifter to be used in each row (or column) to give one dimensional elevation steering. Azimuth control could be provided with a stepper motor.

Figure 6:
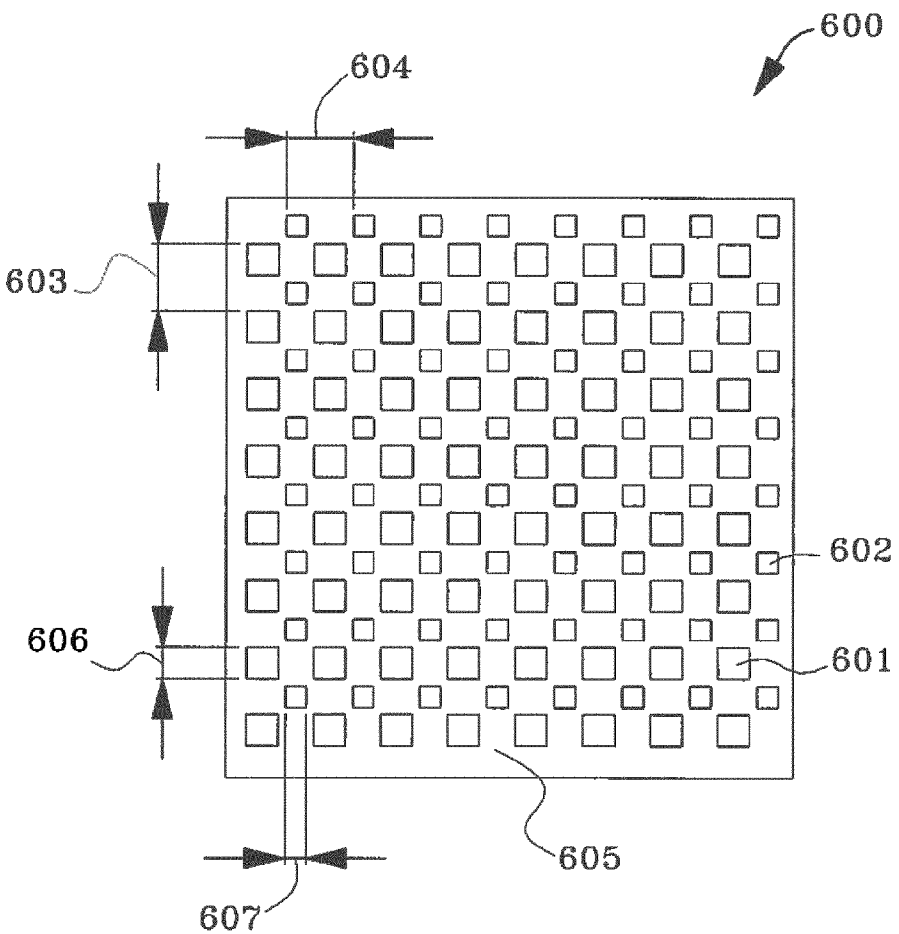
FIG. 6 illustrates a possible layout of interlaced passive radiating elements forming a dual-band (20.2 and 30 GHz) reflectarray capable of simultaneous transmission and reception employing appropriately chosen substrate thickness and dielectric constant for 30 GHz transmit frequency.

FIG. 6 illustrates one exemplary layout 600 of interlaced radiating elements 601, 602 to form a dual-band (20.2 and 30 GHz) reflectarray employing appropriately chosen substrate thickness and dielectric constant for the 30 GHz transmit frequency. Inter-element spacing 603, 604 is 5.03 mm for both arrays and the dielectric material 605 is 0.79 mm thick Epsilam 10. Epsilam 10 has a dielectric constant of 10.2 or higher. The substrate dielectric constant of 10.2 and thickness of (0.031 inches (0.79 mm)) was chosen such that the substrate thickness=$0.25\lambda_g$ ($\lambda_g$=guide wavelength=$\lambda/\sqrt{\in}$, $\lambda$=free space wavelength and $\in$=dielectric constant) at the center of the uplink band, i.e., near 30 GHz. The construction just described substantially allows maintenance of the feed signal. Proper selection of the dielectric constant and thickness at the frequency of interest substantially produces cancellation of the feed image signal by scattering of elements on the front reflectarray surface and reflection from the ground plane. The cross-polarized signal scattered from the elemental radiators on the front surface interferes destructively with the cross-polarized signal reflected from the ground plane on the back surface when the dielectric constant and thickness of the substrate are chosen for the frequency of operation.

Still referring to FIG. 6, as stated in other words above, if the dielectric constant and thickness of the printed circuit board substrate are chosen such that the path length difference between the front (elemental radiator) surface and back (ground plane) surface are about 90 degrees, the cross polarized signal will be greatly diminished because of destructive interference. By judiciously choosing the substrate thickness and dielectric constant, the reflectarray aperture can operate at two distinct frequencies to receive and transmit. Using a relatively high dielectric constant material (e.g. $\in$=10) allows interlacing of the low band and high band elements while preserving the necessary half-wavelength inter-element spacing to prevent grating lobes (i.e. to ensure only one main antenna beam).

Still referring to FIG. 6, the larger 20.2 GHz passive elements 601 have inter-element spacing of $\lambda/3$ of approximately 5 mm and the smaller 30 GHz passive elements 602 have inter-element spacing of $\lambda/2$ of approximately 5 mm which allows, conveniently, interleaved spacing of the dual band arrays together on the same substrate. One channel may be used to transmit and the other to receive. Two receiving channels can be used, for example, one for internet and one for television or radio. The side dimensions 606 of the larger 20.2 GHz patch 601 are approximately 2.31 min and the side dimensions 607 of the smaller 30 GHz patch 602 are approximately 1.55 mm.

Figure 7:
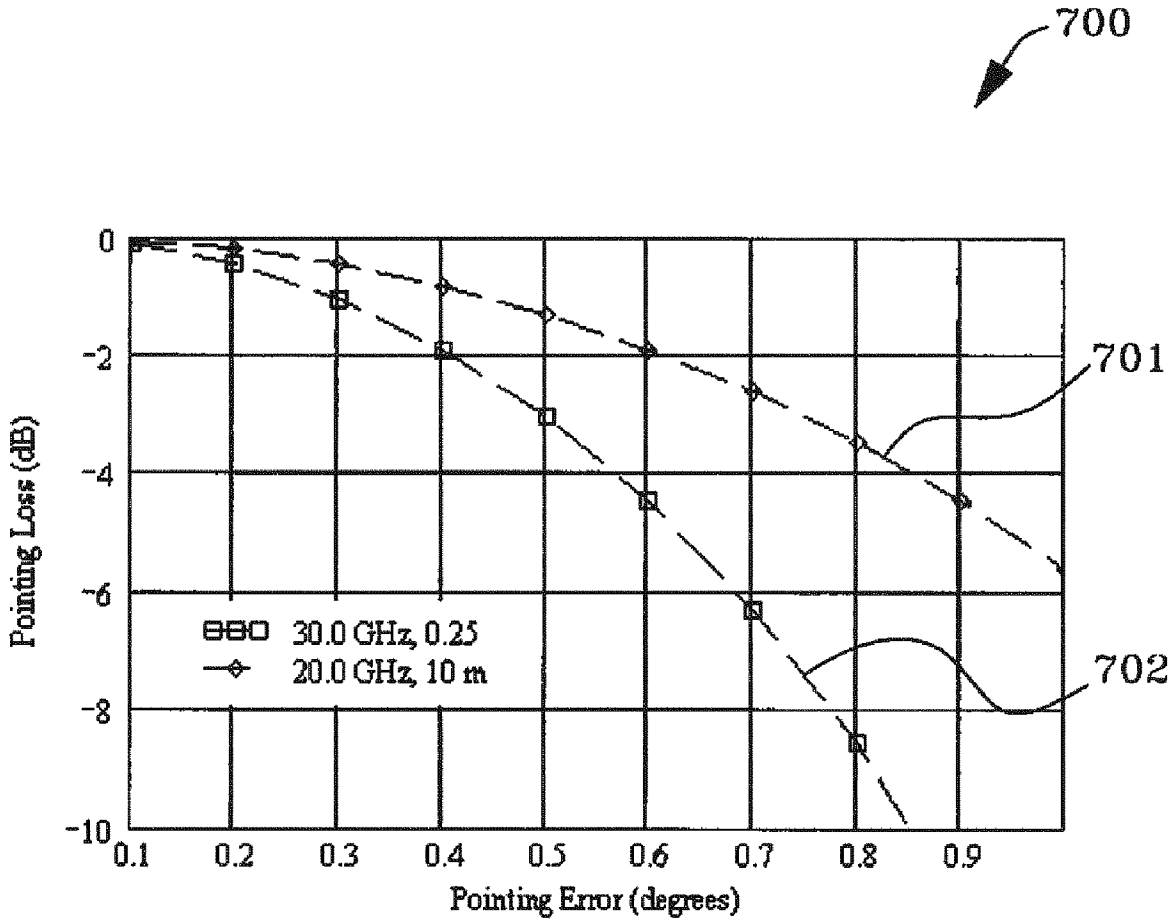
FIG. 7 is the calculated pointing loss for a 0.66 meter diameter reflectarray as a function of pointing error for the purpose of evaluating typical geographical cell size as well as for other purposes.

FIG. 7 is a plot 700 of the calculated pointing loss for a 0.66 meter diameter reflectarray as a function of pointing error for the purpose of evaluating typical geographical cell size. The size of the cell can be determined by the manufacturer. If a pointing error of 0.3 degrees is used, for example, losses of less than 1 dB are achievable with a reasonably good coverage area of the cell thus defined when the geostationary orbit of approximately 23,000 miles is considered. Reference numeral 701 indicates a plot of a 20 GHz signal and reference numeral 702 indicates a plot of the 30 GHz signal.

Figure 8:
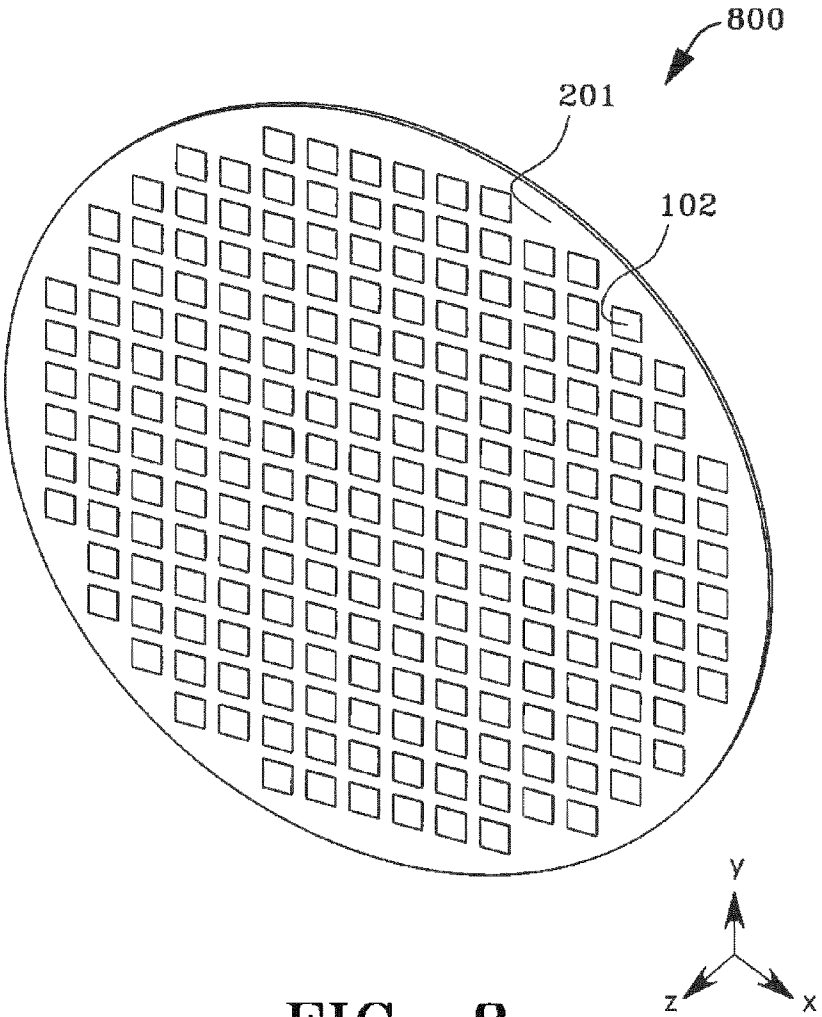
FIG. 8 is a schematic example of a 208 element passive reflectarray.
Figure 8A:
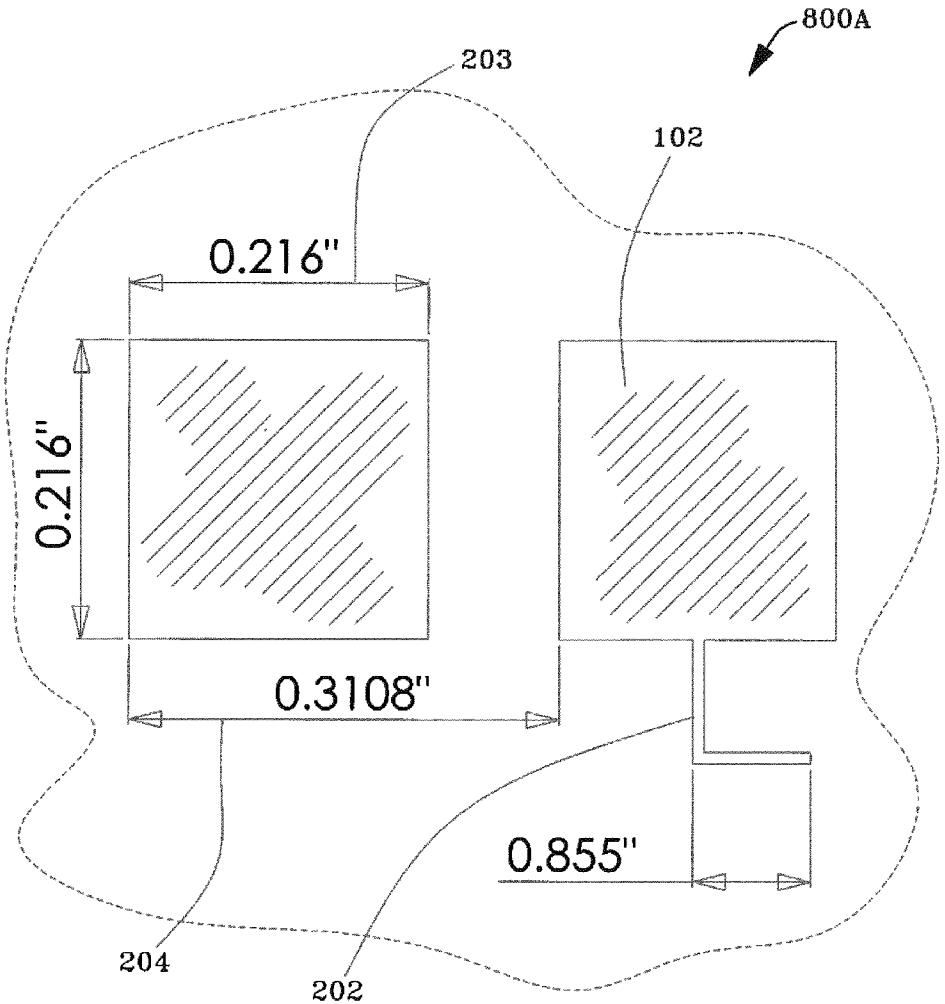
FIG. 8A is a schematic example of inter-element spacing of the reflectarray of FIG. 8.
Figure 8B:
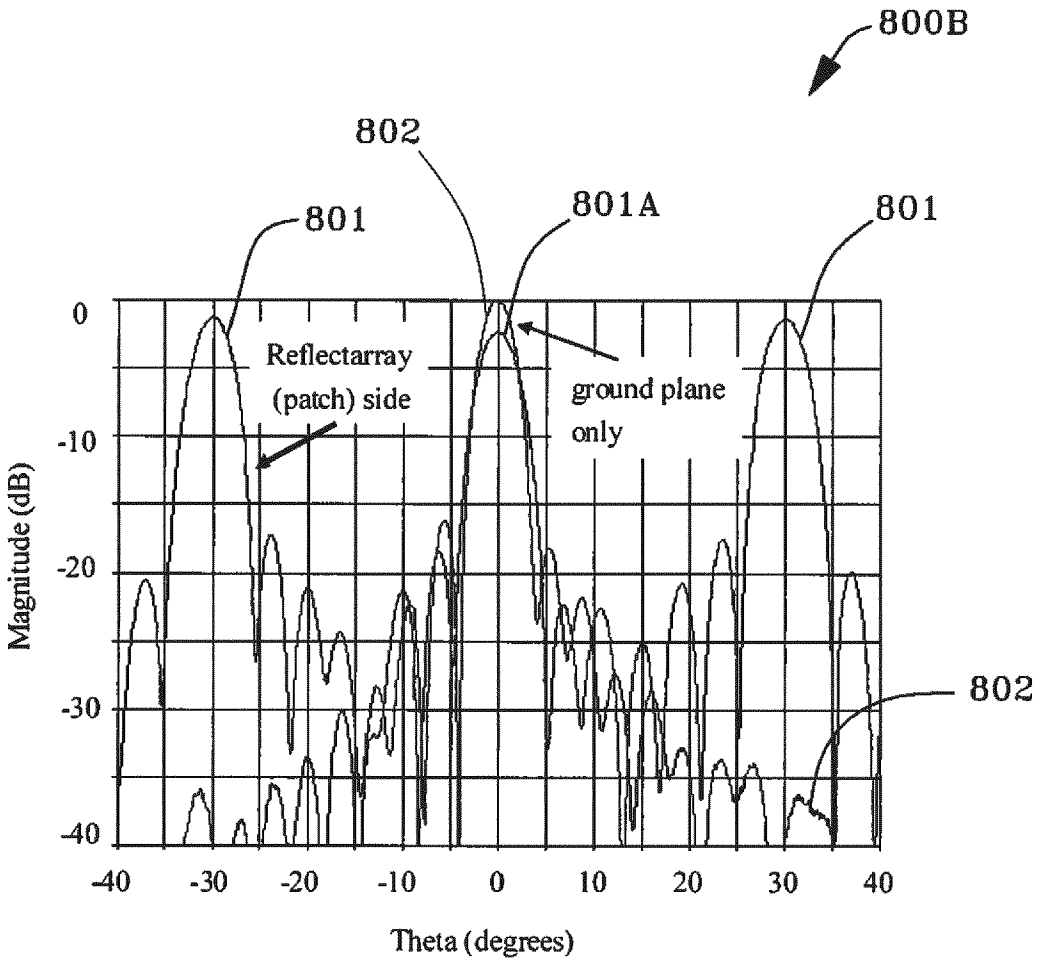
FIG. 8B illustrates the measured 19 GHz radar cross section of the 208 element passive reflectarray constructed on 0.79 mm thick substrate with $\in_f$=2.2 which results in undesirable scattered energy at the boresight.

FIG. 8 is a schematic example 800 of a 208 element passive reflectarray illustrating elements 102. FIG. 8A is a schematic example 800A of inter-element spacing 204 of the reflectarray of FIG. 8. Passive antenna elements 102 are indicated as 0.216 inches square and this distance is the guide wavelength divided by two, $\lambda_g/2$. Inter-element spacing sometimes referred to herein as "d" is 0.3108 inches and is equal to $\lambda/2$ at a frequency of 19 GHz. $\lambda_g=\lambda/\sqrt{\in}$ and $\lambda/4$=the desired substrate thickness to substantially reduce cross-polarization and cancellation of the feed signal. Reference numeral 202 in FIG. 8B indicates a delay line length of 0.0855 inches. FIG. 8B illustrates 800B measured 19 GHz radar cross section of a 208 element passive reflectarray constructed on 0.79 mm thick substrate with $\in_r$=2.2. It will be noted for the example of FIGS. 8, 8A and 8B, that the thickness of the substrate is 0.79 mm which is not equal to the desired substrate thickness of $\lambda_g/4$=2.66 mm for operation at 19 GHz using a substrate having a dielectric of 2.2. In other words, the substrate is not thick enough to cancel undesired radiation (energy) at the boresight 801A very well. As such, the effects of having a mismatched substrate are illustrated in FIG. 8B where the boresight magnitude of the reflected signal is nearly as prominent as the signal is at ±30°.

Consider the E-field pattern shown in FIG. 8B which corresponds to a radar cross-sectional measurement of a 208 element passive reflectarray (shown diagrammatically in FIG. 8) constructed on a 0.79 mm thick substrate with a dielectric constant of 2.2 as described above. Note that the reflectarray of FIG. 8 is designed to operate at 19 GHz and, as such, the selection of a 0.79 mm thick substrate with a dielectric constant of 2.2 is not optimal. Microstrip $\pi$ radian delay lines on every other patch element were oriented such that they would be sensitive only to vertical polarization as indicated in FIG. 8A.

Still referring to FIG. 8B, the array obverse was designed to place main beams 801 at ±30 degrees at 19 GHz. The undesired scattered energy 801A from the ground plane at boresight ($\theta$=0° is nearly as prominent as the desired beams (at ±30°). The image of the feed is projected normal to the reflectarray surface because of scattering, primarily from the ground plane. The array reverse (ground plane only) shows the image pattern 802 of the feed horn.

In practice, the aperture gain must be much greater than the feed gain to mitigate this effect. The solution to the problem illustrated and described in connection with FIGS. 8, 8A and 8B is the selection of the dielectric constant and thickness of the printed circuit board substrate such that the path length difference between the front (elemental radiator) surface and back (ground plane) surface are about 90 degrees, thus greatly diminishing the cross polarized signal because of destructive interference of the respective signals from the feed and reflected from the ground plane.

Figure 9:
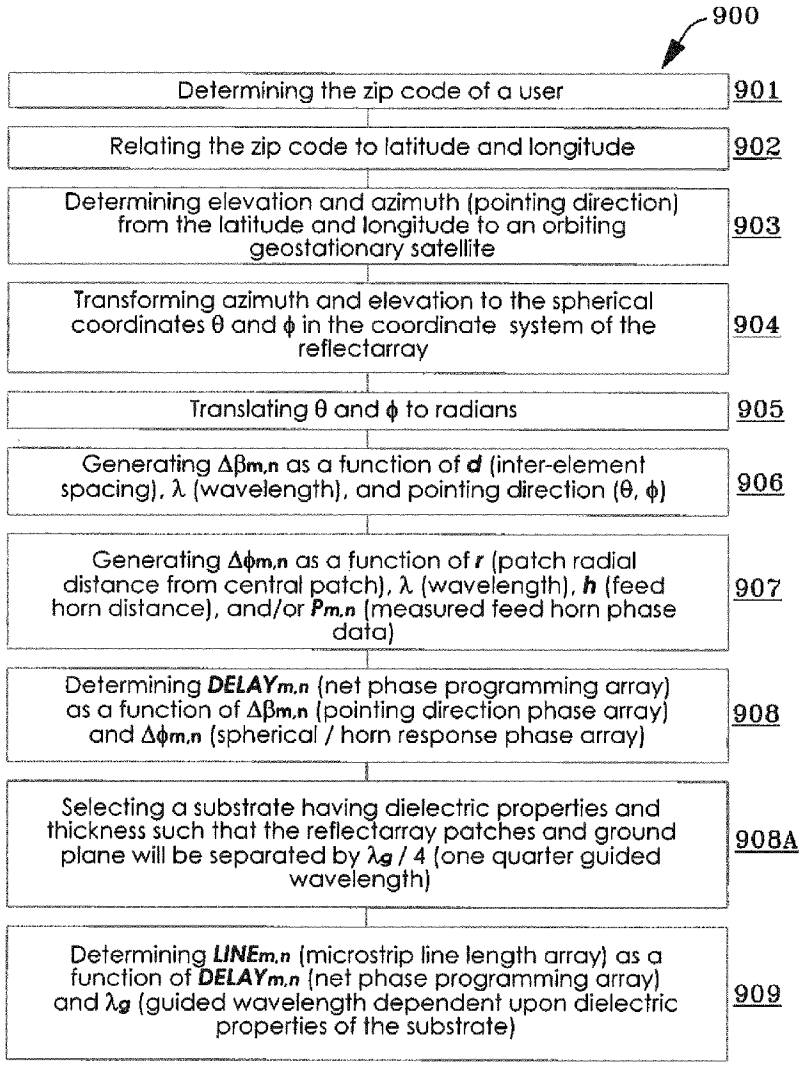
FIG. 9 is a flow chart of some of the process steps used in manufacturing the relectarray antenna.

FIG. 9 is a flow chart 900 of some of the process steps used in manufacturing the relectarray antenna. A method of manufacturing a cellular reflectarray antenna is disclosed and claimed. The reflectarray antenna is arranged in an m by n matrix of elements. The method of manufacturing the antenna includes the step of determining a delay for each of the m by n matrix of elements of the cellular reflectarray antenna. The step of determining a delay for each of the m by n matrix of elements includes sub-steps. The sub-steps include selecting a substrate dielectric constant and thickness equal to $\frac{1}{4}\lambda_g$ at the transmit frequency to minimize reflection of the ground plane 901, determining the zip code of a user 901A, determining the longitude and latitude of the location in which the reflectarray antenna will operate 902, determining elevation and azimuth angles of the reflectarray with respect to an orbiting satellite 903, converting the elevation and azimuth angles to spherical, Cartesian and then a rotated coordinate system to obtain theta ($\theta$) and phi ($\phi$) 904, converting theta ($\theta$) and phi ($\phi$) to $\text{theta}_0$ ($\theta_0$) and $\text{phi}_0$ ($\phi_0$) expressed as radians 905, determining $\Delta\in_{m,n}$ for a given p equal to $d/\lambda$ for a specific array 906, determining $\Delta\phi_{m,n}$ for a given radius from the central element and/or from measured data from the feed horn 907, and, determining a delay for each of said in by n matrix of elements as a function of $\Delta\beta_{m,n}$ and $\Delta\phi_{m,n}$ 908. An additional step of converting the delay 909 calculated in degrees to a stub line length (inches or millimeters) enables the delay line to be printed on the circuit board. The determination of the longitude and latitude 902 may be made by determining the zip code of the user of the antenna 901.

Figure 9A:
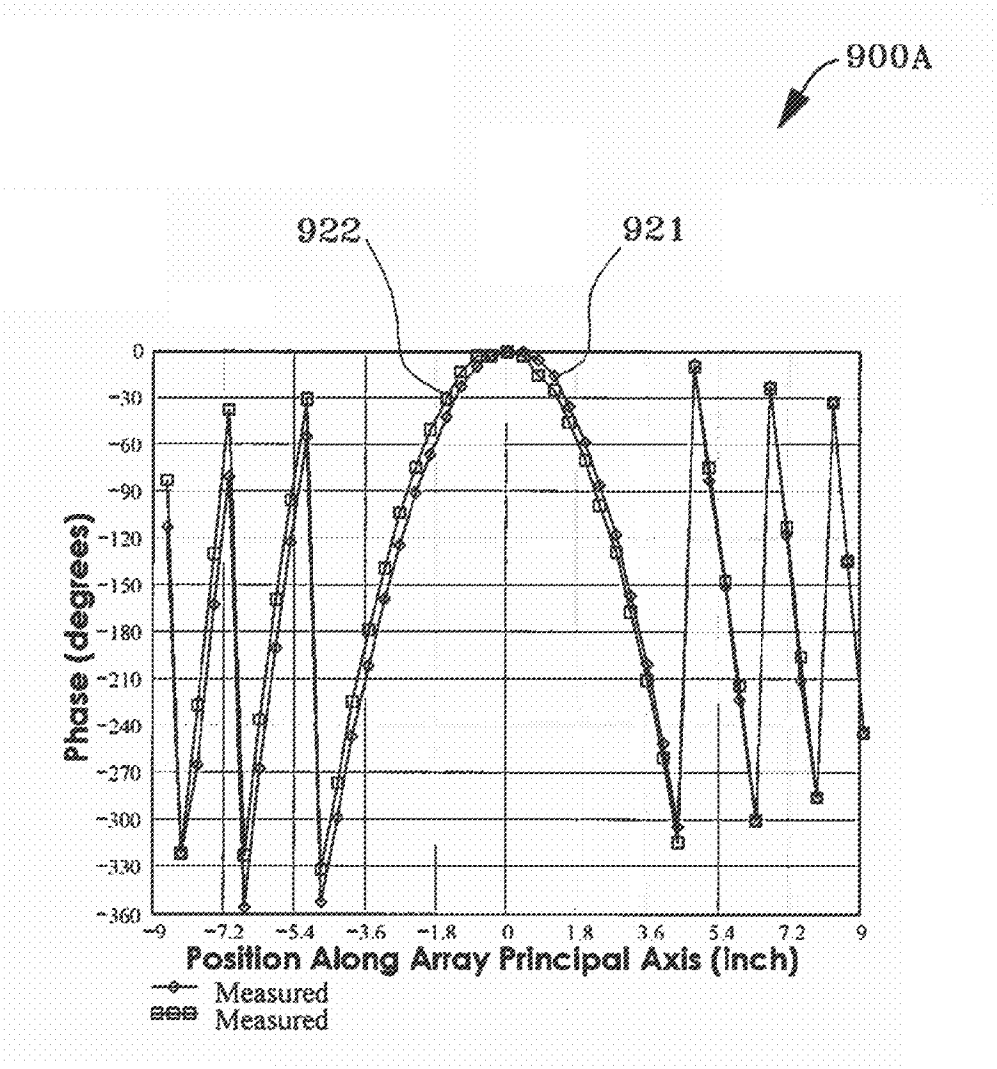
FIG. 9A is an exemplary plot of phase front correction PH (horizontal) and PV (vertical) versus horizontal and vertical position of the elements on the flat reflectarray.
Figure 10:
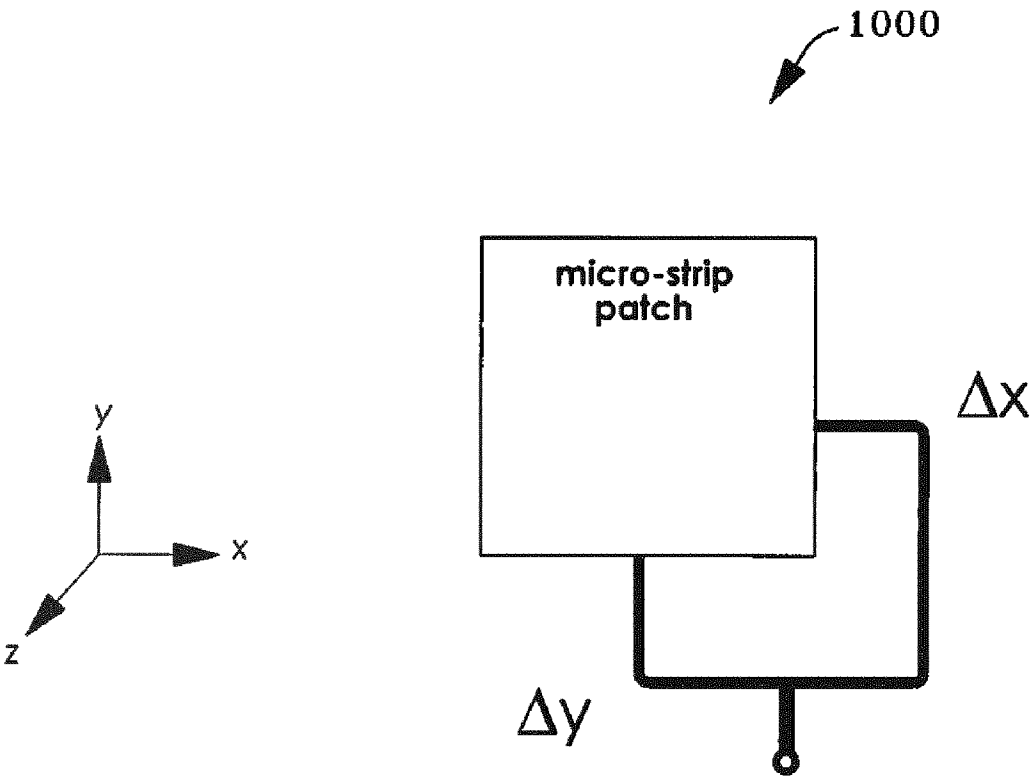
FIG. 10 (PRIOR ART)
FIG. 10 is a prior art schematic of a patch antenna fed orthogonally with microstrip lines for the purpose of evaluating the polarization of the reflected field.

FIG. 9A is an exemplary plot 900A of transformed measured wavefront horizontal phase delay, PH, 921 and vertical phase delay, PV, 922 versus horizontal and vertical position of the elements on the flat reflectarray. The data in FIG. 9A is transformed from measured data to maintain the phase delays of the spherical wave front, $\phi$m,n, between 0° and −360° and includes other transforms to make the central element m,n in an example 59 by 59 array equal to 0° phase correction. Additionally, the phase delays of the pointing vector, $\Delta\beta_{m,n}$, are added to the phase delays of the spherical wave front, $\phi$m,n, and to −360° to arrive at a zero central elemental phase delay.

The software code/process accepts a subscriber's zip code as input and automatically generates the appropriate phase shifter settings of each reflectarray elemental radiator so that the antenna beam is directed to the appropriate satellite for that subscriber's geographic location. The code generates time delays for each passive element of the array. First, a spherical wave front phase delay, $\Delta\phi_{m,n}$ is determined as defined below for each element m,n. In the example given below the inter-element spacing is 0.296 inches which is $\lambda/2$ and corresponds to a frequency of 19.95 GHz. Next, the pointing vector phase delay, $\Delta\beta_{m,n}$, for each element m,n is determined by the $\Delta\beta_{m,n}$ expression below where m,n are elements, $\rho$ is d (inter-element spacing) divided by $\lambda$, and $\theta$ and $\phi$ are pointing angles. Use of the look up table for $\Delta\phi_{m,n}$ involves a given element m, n position and an inter-element spacing constant. $\phi_{m,n}$ can be determined from a look-up table created mathematically (i.e., from calculations) based on the geometry of the feed and its spacing from the reflectarray as well as the size of the array, inter-element spacing and the frequency of operation. Alternatively the look-up table can be modified by interpolating transformed measured data which forces the phase delay to be zero at the central element. All other elements are transformed as well. Still, alternatively, purely transformed measured data comprises the look-up data or a combination of the calculated look-up data and the interpolated transformed measured data may be used. The delay is determined as given below and elsewhere herein and is always between 0° and −360°. Here ρ corresponds to an element's radial distance from the central element. For each element, ρ is calculated and compared to the radial distance range at each category of the lookup table. This method serves to cluster the elements into annular bands wherein the elements grouped into a given band are nominally within plus or minus a selected deviation from the middle of the annulus band, for example, plus or minus 25 degrees.

$$A\beta_{m,n} := \mathrm{mod}[-2\cdot\pi\cdot\rho\cdot[m\cdot(\sin(0_o)\cdot\cos(\phi_o))+n\cdot(\sin(0_o)\cdot\sin(\phi_o))],\ 2\cdot\pi]$$

$$\Delta\phi := \left|\begin{array}{l}
\text{for } m \in 0 \ldots 58 \\
\quad \text{for } n \in 0 \ldots 58 \\
\quad\quad \left[\rho \leftarrow \left[\sqrt{(m-29)^2+(n-29)^2}\right]\cdot 0.296\right] \\
\quad\quad \phi_{m,n} \leftarrow 0 \\
\quad\quad \phi_{m,n} \leftarrow -15.6 \text{ if } 0.75 \le \rho < 1.25 \\
\quad\quad \phi_{m,n} \leftarrow -3.9 \text{ if } 0.25 \le \rho < 0.75 \\
\quad\quad \phi_{m,n} \leftarrow -35.1 \text{ if } 1.25 \le \rho < 1.75 \\
\quad\quad \phi_{m,n} \leftarrow -62.3 \text{ if } 1.75 \le \rho < 2.25 \\
\quad\quad \phi_{m,n} \leftarrow -97.3 \text{ if } 2.25 \le \rho < 2.75 \\
\quad\quad \phi_{m,n} \leftarrow -139.9 \text{ if } 2.75 \le \rho < 3.25 \\
\quad\quad \phi_{m,n} \leftarrow -190.0 \text{ if } 3.25 \le \rho < 3.75 \\
\quad\quad \phi_{m,n} \leftarrow -248.0 \text{ if } 3.75 \le \rho < 4.25 \\
\quad\quad \phi_{m,n} \leftarrow -314 \text{ if } 4.25 \le \rho < 4.75 \\
\quad\quad \phi_{m,n} \leftarrow -27.5 \text{ if } 4.75 \le \rho < 5.25 \\
\quad\quad \phi_{m,n} \leftarrow -108.8 \text{ if } 5.25 \le \rho < 5.75 \\
\quad\quad \phi_{m,n} \leftarrow -197.3 \text{ if } 5.75 \le \rho < 6.25 \\
\quad\quad \phi_{m,n} \leftarrow -294.0 \text{ if } 6.25 \le \rho < 6.75 \\
\quad\quad \phi_{m,n} \leftarrow -38.3 \text{ if } 6.75 \le \rho < 7.25 \\
\quad\quad \phi_{m,n} \leftarrow -149.0 \text{ if } 7.25 \le \rho < 7.75 \\
\quad\quad \phi_{m,n} \leftarrow -266.2 \text{ if } 7.75 \le \rho < 8.25 \\
\quad\quad \phi_{m,n} \leftarrow -32.2 \text{ if } 8.25 \le \rho < 8.75 \\
\quad\quad \phi_{m,n} \leftarrow -166.1 \text{ if } 8.75 \le \rho < 9.25 \\
\phi
\end{array}\right.$$

$$\mathrm{Delay} := \left|\begin{array}{l}
\text{for } m \in 0 \ldots 58 \\
\quad \text{for } n \in 0 \ldots 58 \\
\quad\quad \left| \begin{array}{l} phase_{m,n} \leftarrow -360 + \Delta\beta_{m,m}\cdot\dfrac{180}{\pi} - \Delta\phi_{m,n} \\ \Phi_{m,m} \leftarrow \mathrm{mod}(phase_{m,n}, 360) \end{array}\right. \\
\Phi
\end{array}\right.$$

-continued $$\mathrm{Line} := \left|\begin{array}{l}
\text{for } m \in 0 \ldots 58 \\
\quad \text{for } n \in 0 \ldots 58 \\
\quad\quad length_{m,n} \leftarrow \dfrac{|Delay_{m,n}|}{360}\cdot 215.5 \\
\text{length}
\end{array}\right.$$

Finally, the delay in degrees or radians is converted into a length. The length is then printed along with the elements m,n which form a reflectarray capable of cophasal transmission and reception of circularly or linearly polarized electromagnetic waves. The number "215.5" in the expression is a constant for a given, guided wavelength, substrate dielectric constant and thickness. The 215.5 converts delay (phase shift) to a physical line length based on frequency and substrate dielectric constant and thickness. The example given above is just an example and in practice there will be on constants derived for different applications. The "effective" dielectric constant (some electric field is in air and some in the substrate) is designated as $\in_e$. The wavelength λ is the speed of light "c" divided by [frequency (f) times $\sqrt{\in_e}$. The line length, "l" is then delay/360 times lambda.

REFERENCE NUMERALS

100—perspective view of reflectarray
101—horn feed emitting LHCP, RHC, vertically (linear) polarized or horizontally (linear) polarized electromagnetic waves or radiation
102—flat reflectarray elements
200—schematic of 19×19 element central cellular reflectarray section illustrating the topology of an array surface
201—dielectric substrate
202—delay line
203—4.5 mm width of element
204—7.6 mm interspacing of elements
205—0.2 mm width of delay line
300A is a perspective view of a section of the cellular reflectarray
300B is a cross-sectional view taken along the lines 3B-3B of FIG. 3A
301—ground plane
400A is a plan view of a portion of a reflectarray illustrating a random orientation of the elements to reduce cross-polarization
400B is a plan view of a portion of a reflectarray illustrating patches having random orientations of the delay lines
500—schematic of delay line for emulation of parabolic shape using a variable phase shifter
501—waveguide
502—propagation of spherical wave from waveguide
503—radiating element
504—path length, L
505—path length, L+ΔL
506—phase shifter
600—schematic illustration of one possible layout of interlaced radiating elements to form dual-band (20.2 and 30 GHz) for simultaneous transmission and reception.
601—first set of larger patches for relatively longer wavelength
602—second set of patches for relatively shorter wavelength
603—5.03 mm inter-element spacing between first set of patches
604—5.03 mm inter-element spacing between second set of patches

605—dielectric, Epsilam 10
606—side dimensions of 20.2 GHz patch 601
607—side dimensions of 30 GHz
700—graph of pointing loss dB versus pointing error (degrees)
701—20.0 GHz plot of pointing loss versus pointing error
702—30.0 GHz plot of pointing loss versus pointing error
800—schematic view of 208 element reflectarray
800A—schematic view of two patches of a 208 element array
800B—plot of measured theta (θ) versus magnitude (dB) of electromagnetic waves for a 208 element passive reflectarray
801—plot of reflectarray patch side
801A—undesirable scattered energy at boresight
802—plot of reflectarray ground side
900—flow chart of process steps
900A—is an exemplary plot 900A of measured wavefront horizontal phase delay, PH, and vertical phase delay, versus horizontal and vertical position of the elements on the flat reflectarray
901A—determining the zip code of a user
902—relating the zip code of the user to the longitude and latitude of the location
903—determining elevation and azimuth angles with respect to an orbiting satellite
904—converting the elevation and azimuth angles to spherical, Cartesian and then a rotated coordinate system to obtain theta (θ) and phi (ϕ)
905—converting theta (θ) and phi (ϕ) to $theta_0$ ($\theta_0$) and $phi_0$ ($\phi_0$)
906—determining $\Delta\beta_{m,n}$ for a given ρ equal to d/λ for a specific affray
907—determining $\Delta\phi_{m,n}$ for a given radius from the central element and/or from measured data from the feed horn
908—determining a delay for each element as a function of $\Delta\beta_{m,n}$ and $\Delta\phi_{m,n}$
908A—selecting a substrate dielectric constant and thickness equal to $\frac{1}{4}\lambda_g$ at the transmit frequency to minimize reflection of the ground plane
909—determining the microstrip line length needed to implement the required phase delay
921—measured wavefront horizontal phase delay, PH
922—measured wavefront horizontal phase delay, PV
1000—prior art schematic of patch antenna fed orthogonally with microstrip lines to evaluate polarization of reflected electromagnetic wave The invention has been set forth by way of example only and those skilled in the art will readily recognize that many changes may be made to the invention without departing from the spirit and scope of the claims which are set forth below.

The invention claimed is:

1. A cellular reflectarray antenna for communicating with a satellite comprising:

A substantially flat support surface;

A plurality of antenna elements supported on the support surface;

A feed supported over the support surface for transmitting a signal to the antenna elements or receiving a signal from the antenna elements;

A delay line connected to each antenna element to phase shift the signal to compensate for the spherical wavefront of the signal; and An index element located on the support surface used for aligning the reflectarray antenna with magnetic North.

2. The cellular reflectarray antenna of claim 1, wherein the plurality of antenna elements is oriented on the support surface based upon the latitude and longitude of the mounting location.

3. The cellular reflectarray antenna of claim 2, wherein the plurality of antenna elements is oriented on the support surface based upon the elevation and azimuth angles of the reflectarray antenna with respect to an orbiting satellite.

4. The cellular reflectarray antenna of claim 3, wherein the reflectarray antenna will only work within a specific global cell, generally identified as a 1000 square mile portion of the surface of the earth.

5. The cellular reflectarray antenna of claim 4, wherein the signal transmitted or received by the feed comprises electromagnetic waves or electromagnetic radiation.

6. The cellular reflectarray antenna of claim 5, further comprising antenna elements of different sizes operating at a different wavelengths and frequencies.

7. The cellular reflectarray antenna of claim 1, wherein the length of each delay line, and thus the actual delay of the signal, is based upon the elevation and azimuth angles of the reflectarray antenna with respect to an orbiting satellite.

8. The cellular reflectarray antenna of claim 7, wherein the length of each delay line, and thus the actual delay of the signal, is based upon the latitude and longitude of the location in which the reflectarray antenna will operate.

9. The cellular reflectarray antenna of claim 8, wherein the reflectarray antenna will only work within a certain global cell, generally identified as a 1000 square mile portion of the surface of the earth.

10. The cellular reflectarray antenna of claim 9, further comprising antenna elements of different sizes operating at a different wavelengths and frequencies.

11. The cellular reflectarray antenna of claim 10, wherein the signal transmitted or received by the feed comprises electromagnetic waves or electromagnetic radiation.

12. The cellular reflectarray antenna of claim 1, wherein the support surface comprises a dielectric material.

13. The cellular reflectarray antenna of claim 12, wherein the dielectric material and thickness is based upon the frequency of operation of the reflectarray antenna.

14. The cellular reflectarray antenna of claim 13, wherein the antenna elements are printed on the dielectric material via photolithography.

15. The cellular reflectarray antenna of claim 13, wherein the delay lines are printed on the dielectric material via photolithography.

16. The cellular reflectarray antenna of claim 13, wherein the delay lines extend from an edge of the antenna elements.

17. The cellular reflectarray antenna of claim 13, wherein the delay lines extend from a corner of the antenna elements.

* * * * *